US011969134B2

(12) United States Patent
Laub et al.

(10) Patent No.: US 11,969,134 B2
(45) Date of Patent: Apr. 30, 2024

(54) WET-DRY VACUUM AND LID SYSTEM THEREFOR

(71) Applicants: Adam Laub, Cincinnati, OH (US); Ryan Longshore, Covington, KY (US)

(72) Inventors: Adam Laub, Cincinnati, OH (US); Ryan Longshore, Covington, KY (US)

(73) Assignee: EXAIR CORPORATION, Cincinnati, OH (US)

( * ) Notice: Subject to any disclaimer, the term of this patent is extended or adjusted under 35 U.S.C. 154(b) by 818 days.

(21) Appl. No.: 16/694,271

(22) Filed: Nov. 25, 2019

(65) Prior Publication Data

US 2021/0153704 A1 May 27, 2021

(51) Int. Cl.

| | |
|---|---|
| ***A47L 7/00*** | (2006.01) |
| ***A47L 5/36*** | (2006.01) |
| ***A47L 9/14*** | (2006.01) |
| *A47L 5/12* | (2006.01) |

(52) U.S. Cl.

CPC ..... *A47L 7/0019* (2013.01); *A47L 5/365* (2013.01); *A47L 7/0042* (2013.01); *A47L 9/1445* (2013.01); *A47L 5/12* (2013.01)

(58) Field of Classification Search

CPC ..... A47L 5/365; A47L 9/1445; A47L 7/0042; A47L 7/0019

See application file for complete search history.

(56) References Cited

U.S. PATENT DOCUMENTS 1,986,476 A * 1/1935 Ironside ..... B60R 17/00 15/409
3,605,786 A * 9/1971 Machin, Jr. ..... A47L 7/0038 55/467
3,775,951 A 12/1973 Eicholz et al.
(Continued)

FOREIGN PATENT DOCUMENTS

DE 2521350 11/1976
DE 102005018288 A1 * 10/2006 ..... A47L 5/365
(Continued)

OTHER PUBLICATIONS

EP, European Patent Office, Extended European Search Report; Patent Application Serial No. 20209573.3; 5 pages (dated May 7, 2021).

(Continued)

*Primary Examiner* — Bryan R Muller
(74) *Attorney, Agent, or Firm* — Thompson Hine LLP

(57) ABSTRACT

A lid system for a wet-dry vacuum includes a lid shaped to cover an open end of a container and having a vacuum opening therethrough, and a hatch that engages the lid to cover and seal the vacuum opening when in a closed position and disengages from the lid in an open position to uncover the vacuum opening. A vacuum generator is mounted on the hatch, and a flanged filter is mounted on the lid and extends through the vacuum opening such that the flange supports the filter on the lid. When the hatch is in the closed position, the hatch compresses the flange against the lid to form an airtight seal between with the upper surface of the lid, and (Continued)

the vacuum generator communicates with the interior of the container. When the hatch is in the open position, the filter is insertable into and removable from the vacuum opening.

17 Claims, 3 Drawing Sheets

(56) References Cited

U.S. PATENT DOCUMENTS 3,971,096 A * 7/1976 Renholt ..... A47L 5/18 15/409
4,200,951 A * 5/1980 Burgoon ..... A47L 11/4088 15/353
4,463,474 A 8/1984 Jacobs
4,783,878 A * 11/1988 McCambridge ..... A47L 7/0042 15/327.6
4,841,595 A * 6/1989 Wiese ..... A47L 7/0028 15/352
4,906,265 A * 3/1990 Berfield ..... A47L 9/127 55/486
5,096,472 A * 3/1992 Perry ..... A47L 9/20 55/482
5,142,730 A * 9/1992 Braks ..... A47L 7/0042 15/327.5
5,224,238 A * 7/1993 Bartlett ..... A47L 5/00 15/327.2
6,055,700 A 5/2000 Holsten et al.
7,291,192 B1 11/2007 Lavasser et al.
8,418,312 B2 * 4/2013 Rhea ..... A47L 5/365 15/327.2
8,782,852 B1 * 7/2014 Henderson ..... A47L 5/22 15/327.2
2009/0265882 A1 10/2009 Rhea et al.
2012/0233805 A1 9/2012 Williams
2014/0283330 A1 9/2014 Tardif
2015/0208887 A1 * 7/2015 Moore ..... A47L 7/0071 134/21

FOREIGN PATENT DOCUMENTS

JP 11988177447 11/1988
JP 11991081050 8/1991
JP 2002102124 4/2002

OTHER PUBLICATIONS

JUSTRITE 26754 Vapor Trap™ Drum Lid for 55 gallon Drums—Red; located at https://absupply.net/Justrite-26754-Vapor-Trap-Drum-Lid-for-55-gallon-Drums-Red.aspx, 1 page (at least as early as Aug. 15, 2019).
PIG™ Vapor-Control Latching Drum Lid; located at https://www.newpig.com/pig-vapor-control latching-drum-lid/p/DRM10337couponCode=PLAHOODIE&gclid=EAlalQobChM:68yRyMeFSAIVhlbACh2bCQioEAQYByABEgIOHID_BwE; 6 pages (at least as early as 2011).
Japanese Patent Office, JP Office Action issued Feb. 13, 2024, which pertains to JP Patent Application No. 2020-194007. 7 pgs.

* cited by examiner

WET-DRY VACUUM AND LID SYSTEM THEREFOR

TECHNICAL FIELD

The present disclosure relates to air operated tools such as drum vacuums for vacuuming liquids and solids, and more particularly, to compressed air operated wet-dry vacuums.

BACKGROUND

Vacuum devices, in particular drum vacuums, have wide commercial and industrial application because of their large capacity and capability of vacuuming both abrasive and corrosive materials. Such devices typically comprise a container and a lid containing a connector to a vacuum hose and a vacuum generating component. The lid is removably attached to the container so that the contents may be emptied easily. The vacuum generating component may be an impeller driven by an electric motor, and in other applications the vacuum generating component is a compressed air powered venturi tube. The inlet to the vacuum generating component is shielded by a filter to retain the vacuumed particulates in the container and minimize fouling of the vacuum generator components.

Wet-dry vacuums are designed to suction up liquids as well as solids. Such vacuums include a float valve located within the container that is attached to the vacuum generating inlet. To convert a wet-dry vacuum from vacuuming dry material to vacuuming liquid material, it is necessary to remove the filter from the vacuum, which otherwise would become saturated with the vacuumed liquid and block air flow to the vacuum generating component. Overfilling the container and flooding the vacuum generating component is prevented by the float valve, in which a valve, such as a buoyant ball, is lifted by the rising liquid contents of the container and seats against an inlet tube to the vacuum generating component. U.S. Pat. No. 3,775,951, titled "VACUUM CLEANER," the entire contents of which are incorporated herein by reference, describes an example of such a wet-dry vacuum.

Such wet-dry vacuum cleaners typically utilize a large drum, such as a 30-, 55-, or 110-gallon metal drum, for the container. The lid containing the vacuum generating component is removably attached to the open top of the drum by releasable fasteners or a locking ring. To remove the filter of such a wet-dry vacuum cleaner to convert operation from dry vacuuming to wet vacuuming, the fasteners or locking ring must be unfastened and the lid removed from the container to gain access to the filter and remove it. Such a conversion is time-consuming and requires removal of the entire lid from the container, which exposes an operator to the interior of the container. Accordingly, there is a need for a wet-dry vacuum that can be converted between vacuuming dry material and vacuuming liquids easily and without having to remove the entire lid from the container.

SUMMARY

The present disclosure describes a lid system for a wet-dry vacuum, and a wet-dry vacuum incorporated the lid system, which in embodiments is a drum vacuum, that can be converted quickly and easily between a configuration for vacuuming dry particulate material and a configuration for vacuuming liquids or slurries. The conversion is effected by providing the drum vacuum with a lid having a removable hatch that covers an opening into the interior of the drum that retains a particulate filter. The filter can be inserted into and removed from the opening in the lid to configure the wet-dry vacuum as a dry vacuum or a wet vacuum, respectively, thereby eliminating the need to remove the entire lid to configure the wet-dry vacuum to a wet vacuum or a dry vacuum.

In an embodiment, the lid system for a wet-dry vacuum includes a lid shaped to cover an open end of a container, the lid having a vacuum opening therethrough; a hatch that engages the lid to cover and seal the vacuum opening when the hatch is in a closed position, and disengages from the lid in an open position to uncover the vacuum opening; a vacuum generator mounted on the hatch, and a filter having a flange, the filter mounted on the lid and extending through the vacuum opening such that the flange engages an upper surface of the lid adjacent the vacuum opening to support the filter on the lid. When the hatch is in the closed position, the hatch compresses the flange against the lid to form an airtight seal between the hatch and the flange, and between the flange and the upper surface of the lid, such that the vacuum generator communicates with the interior of the container. Orienting the hatch in the open position allows the filter to be inserted into and removed from the lid.

In another embodiment, a wet-dry vacuum includes a drum having an open end; a lid covering the open end and having a vacuum opening therethrough; a hatch pivotally connected to the lid for covering the vacuum opening, the hatch pivoting between an open position, wherein the hatch is away from the vacuum opening, and a closed position, wherein the hatch covers the vacuum opening. A vacuum generator is mounted on the hatch, and a flanged filter is mounted on the lid and extends through the vacuum opening into an interior of the drum such that the flange engages an upper surface of the lid adjacent the vacuum opening to support the filter on the lid. When the hatch is pivoted to the closed position, the hatch compresses the flange against the lid to form an airtight seal between the hatch and the flange, and between the flange and the upper surface of the lid, such that the vacuum generator communicates with the interior of the drum. Pivoting the hatch to the open position allows the filter to be inserted into and removed from the lid.

In yet another embodiment, a method for making a lid system for a wet-dry vacuum includes forming a lid shaped to cover an open end of a container, and forming a vacuum opening through the lid; pivotally attaching a hatch to the lid so that the hatch pivots between an open position wherein the hatch is away from the vacuum opening, and a closed position wherein the hatch covers the vacuum opening. The method further includes mounting a vacuum generator on the hatch and mounting a flanged filter on the lid to extend through the vacuum opening such that the flange engages an upper surface of the lid adjacent the vacuum opening to support the filter on the lid. Pivoting the hatch to the closed position compresses the flange against the lid to form an airtight seal between the hatch and the flange, and between the flange and the upper surface of the lid, such that the vacuum generator communicates with the interior of the container. Pivoting the hatch to the open position permits the filter to be inserted into and removed from the lid through the vacuum opening.

Other objects and advantages of the disclosed wet-dry vacuum and lid system therefor will be apparent from the following description, the accompanying drawings, and the appended claims.

DETAILED DESCRIPTION

Figure 1:
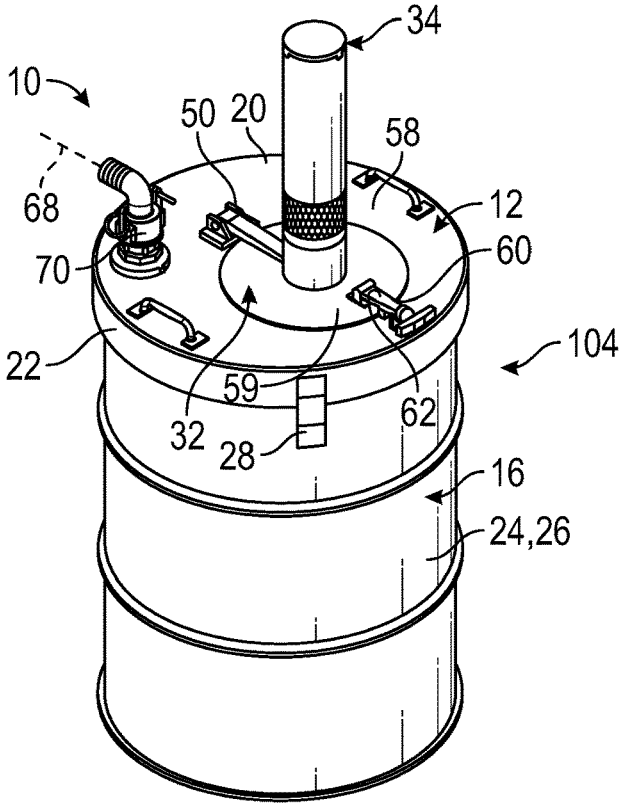
FIG. 1 is a perspective view of an embodiment of the disclosed wet-dry vacuum with the hatch closed.
Figure 2:
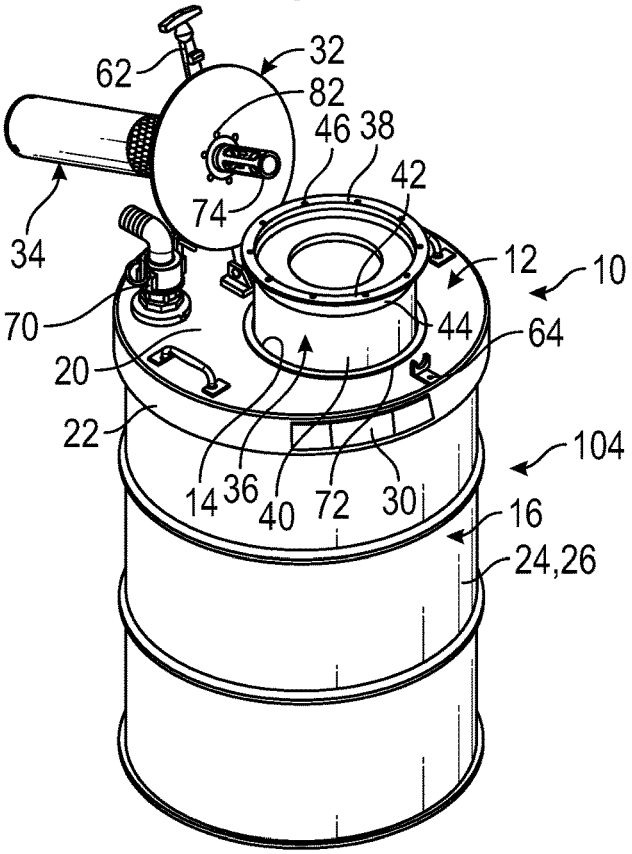
FIG. 2 is a perspective view of the embodiment of FIG. 1 with the hatch open and the filter partially removed.
Figure 3:
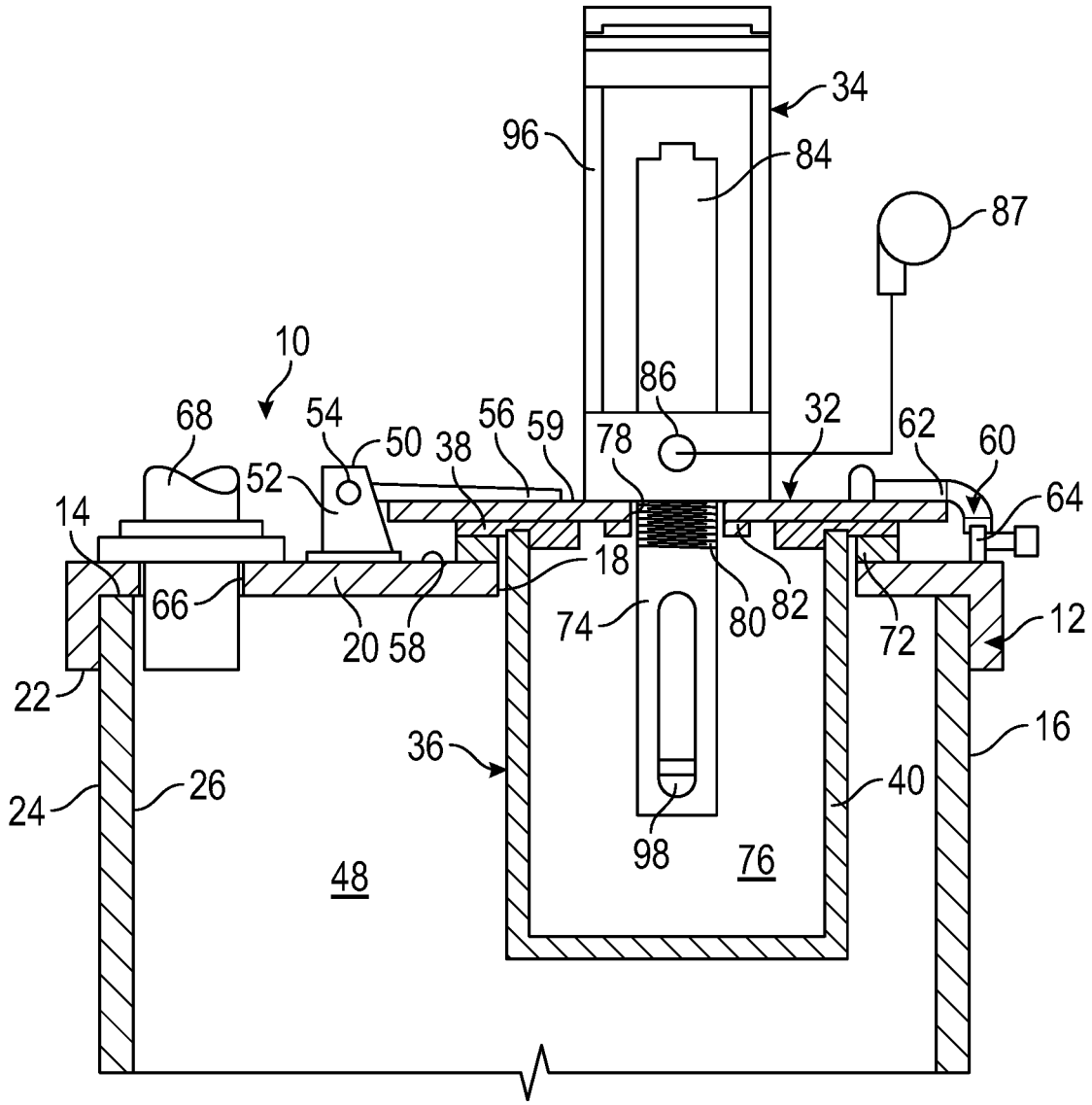
FIG. 3 is a partial side elevation in section of the wet-dry vacuum of FIG. 1
Figure 4:
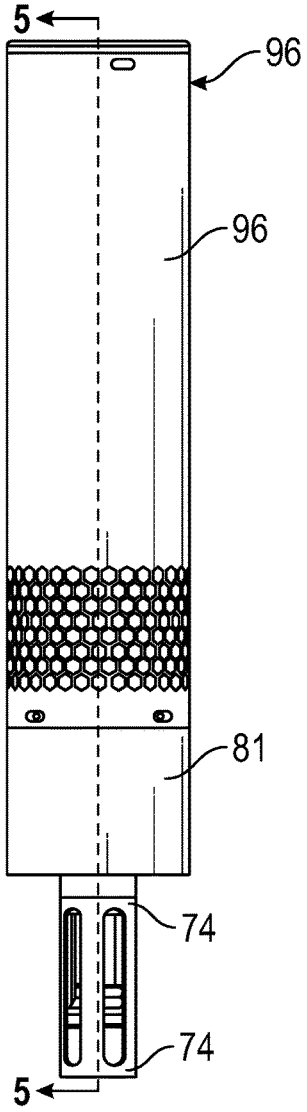
FIG. 4 is a detail side elevation of a vacuum generator of the embodiment of FIG. 1.

As shown in FIGS. 1, 2, and 3, a lid system, generally designated 10, for a wet-dry vacuum includes a lid 12 shaped to cover an open end 14 of a container 16. The lid 12 has a vacuum opening 18 therethrough. In embodiments, the lid 12 includes a flat cover plate 20 terminating in a peripheral rim 22 that engages an outer surface of the 24 of the side wall 26 of the container 16. In an exemplary embodiment, the peripheral rim 22 includes over-center latches 28 (one shown in FIG. 1) spaced about the periphery that releasably secure it to the side wall 26 of the container 16. In another embodiment, the rim 22 takes the form of a locking ring 30 (shown in FIG. 2) with an over-center latch that releasably secures the cover plate 20 to the container 16.

In embodiments, the container 16 takes the form of a metal drum, such as a 5-, 30-, 55-, or 110-gallon ribbed drum. In other embodiments, the container 16 takes the form of a plastic drum. The side wall 26 of the container 16 shown in the figures is cylindrical, with a round open end 14 and the lid 12 includes a round cover plate 20 matching in size and shape. In other embodiments of the lid system 10, the side wall 26 of the container 16 and/or open end 14 take other shapes, such as hexagonal, other polygonal shapes, or square or rectangle, with rounded corners.

The lid system 10 includes a hatch 32 that engages the lid 12 to cover and seal the vacuum opening 18 when the hatch is in a closed position, as shown in FIGS. 1 and 3, and disengages from the lid in an open position to uncover the vacuum opening, as shown in FIG. 2. The hatch 32 is sized to completely cover the vacuum opening 18. In an embodiment, the vacuum opening 18 is round, and the hatch 32 also is round and has a diameter greater than the diameter of the vacuum opening so that it overlies the cover plate 20 in the area bordering the vacuum opening. A vacuum generator 34 is mounted on the hatch 32 and communicates with the interior of the container 16.

A filter 36 includes a flange 38 and is mounted on the lid 12. The filter 36 extends through the vacuum opening 18 such that the flange 38 engages and rests upon an upper surface 58 of the cover plate 20 of the lid 12 adjacent the vacuum opening to support the filter on the lid. In an embodiment, the filter 36 includes a wall 40 that is generally cylindrical in shape and is closed on the side and bottom, with an open top bounded by and secured to the flange 38. In embodiments, the filter wall 40 is made of cloth, paper, or open-cell foam that is sufficiently rigid to resist collapsing from the pressure differential across the wall caused by the vacuum generator 34.

In some embodiments, the filter wall 40 is pleated and is permeable to air but not to particulates, including airborne particles such as dust, wood, metal shavings, dirt, and fibers. In other embodiments, the wall 40 is a paper, cloth, or open-cell foam sack that fits over a plastic or metal frame that provides shape and support. In embodiments, the flange 38 is attached to the wall 40 by an adhesive. In other embodiments, the flange 38 is comprised of two rings 42, 44 that clamp the open top of the wall 40 between them with screws 46.

In an embodiment, the flange 38 is circular in shape, and matches the shape of the vacuum opening 18, but is of greater diameter than the vacuum opening. Thus, the flange 38 supports the filter 36 on the cover plate 20 so that the filter is suspended from the cover plate and the wall 40 extends into an interior 48 of the container 16. Alternatively, the filter 36 and flange 38 are unitary item, such as the Model 901357 HEPA filter sold by EXAIR Corporation of Cincinnati, Ohio.

When the hatch 32 is in the closed position (see FIGS. 1 and 3), the hatch compresses the flange 38 against the lid 12 to form an airtight seal between the hatch and the flange, and between the flange and the upper surface of the lid, such that the vacuum generator 34 communicates with an interior 48 of the container 16. When the hatch 32 is in the open position, as shown in FIG. 2, the filter 36 is removable from the vacuum opening 18 in the lid 12 by lifting the filter upwardly from the lid and through the vacuum opening 18. Conversely, the filter 36 is easily installed in the lid system 10 when the hatch 32 is in the open position by inserting the filter through the vacuum opening 18 until the flange 38 rests on the upper surface 58 of the lid 12. The filter wall 40 is sized and shaped to conform in contour with and fit through the vacuum opening 18. In the embodiment of FIGS. 1 and 2, the filter 36 is shown as having a wall 40 that is cylindrical in cross section. In other embodiments, the wall 40 may oval, square, or polygonal in cross section. With such other shapes of wall 40, the vacuum opening 18 and hatch 32 may be similarly shaped.

In an embodiment, the hatch 32 is pivotally attached to the lid 12, whereby the hatch pivots to an open position (FIG. 2) and to a closed position (FIG. 1). In embodiments, the hatch 32 is attached to the lid 12 by a hinge 50 having a clevis 52 that rotatably receives a pin 54. A leaf 56 is attached to the pin 54 between the knuckles of the clevis 52 and is attached, for example by fasteners, welding, brazing, or an adhesive, to an upper surface 59 of the hatch 32. In an embodiment, the hatch 32 includes a latch 60 that holds the hatch against the lid 12 to form an airtight seal when the hatch is in the closed position. In the embodiment shown, the latch 60 includes an elastic strap 62 that is attached at one end to the hatch 32, for example by screws and/or an adhesive, and is releasably attached at an opposite end to a retaining prong 64 that is attached to the upper surface 58 of the lid 12. In other embodiments, the hatch 32 is releasably attachable to the lid 12 by a threaded connection, a bayonet mount, or by over-center buckles.

The lid 12 also includes a hose opening 66 therethrough for connection to a vacuum hose 68 that in the embodiments of FIGS. 1 and 2 includes a quick release coupling 70. Also, in embodiments the vacuum hose 68 is attachable to one or more vacuum attachments (not shown), such as a wand, a crevice tool, a skimmer tool, a brush, a squeegee tool, and a floor tool.

In an embodiment, the lid system 10 optionally includes a gasket 72 positioned between the hatch 32 and the upper surface 58 of the lid 12 when the hatch is in the closed position. The gasket 72 ensures an airtight seal between the hatch 32 and the lid 12 when the hatch is in the closed position. In a particular embodiment, the gasket 72 is positioned between the flange 38 and the upper surface 58 of the lid 12, so that the hatch 32 makes an airtight seal with the flange 38, which also may be made of the same material as the gasket 72, and the flange 38 compresses the gasket against the upper surface 58 to make an airtight seal with the lid 12. In an embodiment, the gasket 72 is attached to the lid 12 by an adhesive, such as to the upper surface 58, and is adjacent and extends about a periphery of the vacuum opening 18. In embodiments, the gasket 72 is made of an elastomer, and in other embodiments is made of rubber, foam, silicone, cork, or plastic polymer.

In an embodiment, the vacuum generator 34 incudes a float tube 74 that extends through the vacuum opening 18 into the interior 76 of the filter 36. The float tube 74 functions when the lid system 10 is configured for wet or liquid vacuuming, and the filter 36, which functions to retain particulates within the container 16, is removed from the lid 12. In an embodiment, float tube 74 is a valve that closes when the liquid contents of the interior 48 reach a predetermined level in the container 16 to prevent liquid from entering the vacuum generator 34. The hatch 32 includes an opening 78 that receives the float tube 74 therethrough, so that the float tube extends through the vacuum opening 18 and into the interior 48 of the container 16.

Figure 5:
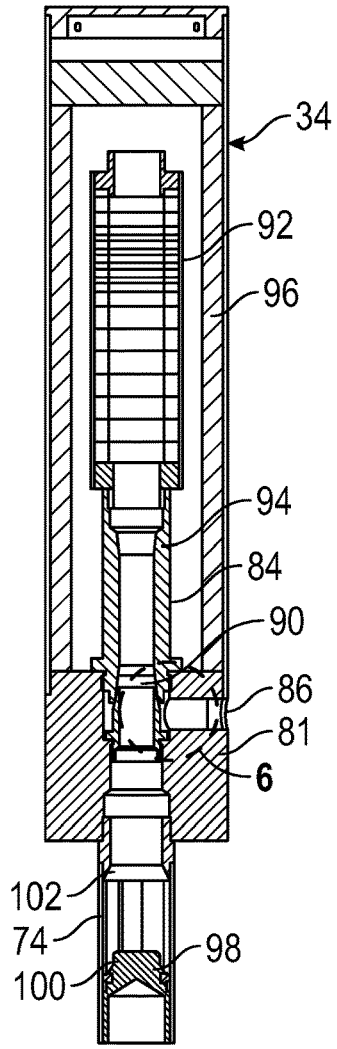
FIG. 5 is a side elevation in section of the vacuum generator of FIG. 3.
Figure 6:
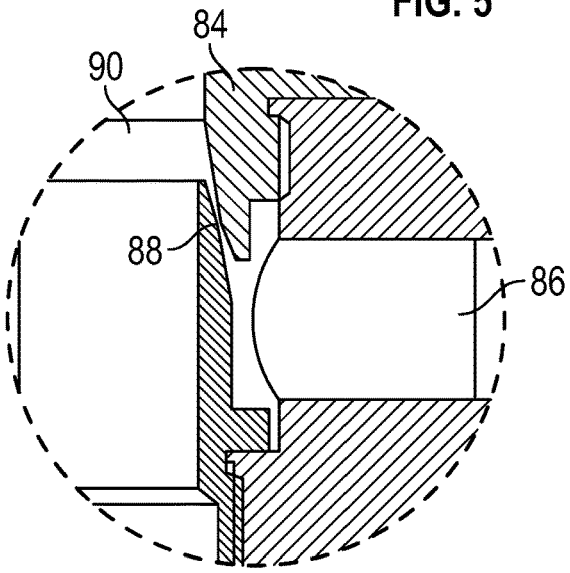
FIG. 6 is a detail showing the venturi of the vacuum generator of FIG. 4.

The float tube 74 includes a threaded segment 80 that screws into a complementary threaded bore (see FIG. 5) in the base 81 of the vacuum generator 34. Screws 82 extend through holes in the hatch 32 and thread into complementary holes in the base 81 of the vacuum generator 34, thereby securing the vacuum generator to the hatch. In embodiments, the vacuum generator 34 is may take the form of a compressed air powered vacuum generator, shown in the figures, and an electric blower.

As shown in FIGS. 3, 4, 5, and 6, in an exemplary embodiment, the compressed air powered vacuum generator 34 is in the form of a compressed air powered venturi tube 84, such as an E-Vac® vacuum generator available from EXAIR Corporation, Cincinnati Ohio. The base 81 of the venturi tube 84 includes a threaded compressed air inlet 86 that connects to a source of compressed air 87 and directs the compressed air to a single directed nozzle 88, where it exhausts through a venturi 90 to generate a vacuum that evacuates the air from the interior 48 of the container 16, thus lowering the pressure below ambient and creating suction in the vacuum hose 68. In an embodiment, the vacuum generator 34 includes an inline felt muffler 92 that is attached to an exhaust tube 94. Also, in an embodiment an additional, outer muffler 96 encloses the muffler 92 and venturi tube 84 for further noise reduction.

The float tube 74 is upstream of the venturi tube 84. As shown best in FIG. 5, the float tube 74 is hollow and is connected to the base of the venturi tube 84. In embodiments, the float tube 74 has an open bottom and/or elongate openings along its length. The float tube 74 retains a cylindrical float 98 that is buoyant and is captured within the tube, for example by a snap ring in the bottom of the tube. In an embodiment, the float 98 is slidable along the vertical length of the float tube 74 and is in the form of an inverted cup having a tapered top 100 that engages and seats against a complementary tapered orifice 102 at the top of the float tube 74.

Thus, as the volume of the liquid contents of the container 16 nears the top of the container to the point where the surface of the liquid reaches the float tube 74, the rising liquid raises the float 98 within the float tube, which continues to rise until it seats against the tapered orifice 102 and seals air flow through the float tube 74 to the venturi tube 84. Thus, the vacuum generator 34 is sealed from the interior 48 of the container 16, and the vacuum or below ambient air pressure within the interior 48 of the container from the vacuum generator 34 ceases. This prevents the liquid within the container from entering the vacuum generator 34, fouling the vacuum generator 34, and leaving the container.

In another embodiment, the disclosed lid system 10 is incorporated into a wet-dry vacuum, generally designated 104. The wet-dry vacuum 104 includes a container 16 in the form of a drum having an open end 14, and a lid 12 covering the open end. The lid 12 has a vacuum opening 18 therethrough. The hatch 32 is pivotally connected to the lid for covering the vacuum opening. In embodiments, the hatch 32 is connected to the lid 12 by a hinge 50 and pivots between an open position, wherein the hatch is away from the vacuum opening, and a closed position, wherein the hatch covers the vacuum opening.

The vacuum generator 34 is mounted on the hatch 32, and a filter 36 having a flange 38 is mounted on the lid 12 and extends through the vacuum opening 18 into the interior 48 of the drum 16. The flange 38 engages an upper surface 58 of the lid 12 adjacent the vacuum opening 18 to support the filter 36 on the lid. When the hatch 32 is pivoted to the closed position (FIG. 1), the hatch compresses the flange 38 against the lid 12 to form an airtight seal between the hatch and the flange, and between the flange and the upper surface 58 of the lid 12 such that the vacuum generator 34 communicates with the interior of the drum 16. When the hatch 32 is pivoted to the open position (FIG. 2), the filter 36 is insertable into and removable from the vacuum opening 18 in the lid 12.

The vacuum generator 34, which in embodiments is a venturi operated by compressed air, draws air from the interior 48 of the container 16 and creates suction in vacuum hose 68 to effect the vacuuming function, so that the particulate material is drawn through the hose and into the interior of the container. The filter 36 prevents the particulate material in the interior 48 from entering the vacuum generator 34. After vacuuming is completed, the lid 12 can be removed from the container 16, either by releasing the over-center latches 28 or by releasing the locking ring 30, and the contents of the container can be emptied. After emptying the container 16, the lid 12 is reattached to cover the open end 14 of the container.

To operate the wet-dry vacuum 104 to vacuum particulate material, the strap 62 of the latch 60 is disconnected from the retaining prong 64 and the hatch 32 pivoted to the open position shown in FIG. 2. The filter 36 is inserted into the vacuum opening 18 until the flange 38 rests upon the upper surface 58 and/or the gasket 72. The hatch 32 is then closed and secured with the latch 60 in the closed position shown in FIGS. 1 and 3. The source of compressed air 87 is activated, either by opening a valve on the line to the vacuum generator 34 or by starting a compressor, and the compressed air flows to the vacuum generator. The vacuum generator 34 is in fluid communication with the interior 48 of the container 16, so that the vacuum generator lowers the air pressure within the container below atmospheric. The vacuum hose 62, which is in fluid communication with the interior 48 of the container 16, sucks particulate matter into the container. The particulate matter is retained within the container by the filter 36. After vacuuming the lid 12 is removed from the container 16 and the contents emptied from the interior 48.

To operate the wet-dry vacuum 104 to vacuum liquids or slurries, the strap 62 of the latch 60 is disconnected from the retaining prong 64 and the hatch 32 pivoted to the open position shown in FIG. 2. The filter 36 is thus exposed and is extracted from the vacuum opening 18, and the hatch 32 is then closed and once again secured with the latch 60. The vacuum opening 18 is sealed from the ambient environment by the engagement between the hatch 32 with the gasket 72 and/or upper surface 58 of the lid 12. The elastic strap 62 of the latch 60 maintains a clamping force of the hatch 32 against the lid 12 to ensure an airtight seal in the closed position.

The source of compressed air 87 is activated, either by opening a valve on the line to the vacuum generator 34 or by starting a compressor, and compressed air flows to the vacuum generator, so that the vacuum generator lowers the air pressure within the container below atmospheric. The vacuum hose 62, which is in fluid communication with the interior 48 of the container 16, sucks liquid or slurry into the interior 48 of the container. The liquid is retained within the container by the float valve 74, which seals the venturi 84 from the interior 48 if the liquid level in the container 16 reaches a predetermined level that raises the float 98 to seal against the tapered orifice 102. After vacuuming, the lid 12 is removed from the container 16 and the contents emptied from the interior 48.

A method for making the lid system 10 for the wet-dry vacuum 104 includes forming a lid 12 shaped to cover an open end 14 of a container 16, and forming a vacuum opening 18 through the lid. The lid 12 is pivotally attached to the lid, in embodiments by a hinge 50. The hinge 50 allows the hatch 32 to pivot between an open position, wherein the hatch is away from the vacuum opening 18, and a closed position, wherein the hatch covers the vacuum opening. A vacuum generator 34 is mounted on the hatch 32. A flanged filter 36 is mounted on the lid 12 to extend through the vacuum opening 18 such that the flange engages an upper surface 58 of the lid adjacent the vacuum opening to support the filter 36 on the lid.

Thus, when the hatch 32 is pivoted to the closed position, the hatch compresses the flange 38 against the lid 12 to form an airtight seal between the hatch and the flange 38, and between the flange and the upper surface 58 of the lid, such that the vacuum generator 34 communicates with the interior 48 of the container 16. When the hatch 32 is pivoted to the open position, the filter 36 is removable from the lid 12 through the vacuum opening 18.

The disclosed wet-dry vacuum 104 and lid system 10 provide a low-cost, robust vacuum system for both liquid and particulate vacuuming with few moving parts. The filter 36 is easily removable simply by opening the hatch 32 and lifting it out through the vacuum opening 18, then resealing the hatch to the lid. This facilitates changing the filter 36, as well as converting the wet-dry vacuum system easily between dry/particulate and wet/liquid vacuum operation. There is no need to remove the lid 12 and expose the vacuumed contents in the interior 48 of the container to the ambient environment when converting between wet and dry vacuuming operation modes. To empty the contents of the container 16, the lid 12 is easily removed, leaving only the container; all of the vacuum components are attached to the lid 12.

While the forms of apparatus and methods disclosed herein constitute preferred embodiments of the disclosed wet-dry vacuum and lid system, the invention is not limited to these precise apparatus and methods, and changes may be made therein without departing from the scope of the invention.

What is claimed is:

1. A device including a lid system for a wet-dry vacuum, the lid system comprising:

a lid shaped to cover an open end of a container, the lid having a vacuum opening therethrough;

a hatch pivotally coupled to the lid and configured to cover the vacuum opening when the hatch is in a closed position, and configured to uncover the vacuum opening when the hatch is in an open position, the hatch having an outer perimeter;

a vacuum generator mounted on the hatch, the vacuum generator having an outer perimeter, at least part of which is spaced away from the outer perimeter of the hatch; and a filter having a flange, the filter being configured to be mounted on the lid and extend through the vacuum opening such that the flange engages an upper surface of the lid to support the filter on the lid;

wherein the vacuum generator includes a float tube that extends through the vacuum opening into an interior of the filter wherein the lid system is configured such that when the hatch is in the closed position and the filter is mounted on the lid, the hatch sealingly engages the flange about an entire perimeter thereof to form an airtight seal between the hatch and the flange; and wherein the lid system is configured such that when the hatch is in the open position, the filter is insertable into and removable from the vacuum opening.

2. The device of claim 1, whereby the hatch pivots between the open position and the closed position.

3. The device of claim 1, wherein the lid includes a hose opening therethrough for receiving or for connection to a vacuum hose.

4. The device of claim 1, further comprising a gasket positioned between the hatch and the upper surface of the lid when the hatch is in the closed position, wherein the gasket is positioned between the flange and the upper surface of the lid, and wherein the gasket extends about a periphery of the vacuum opening.

5. The device of claim 1, further comprising a latch that holds the hatch against the lid to form an airtight seal between the hatch and the lid when the hatch is in the closed position.

6. The device of claim 1, wherein the hatch incudes an opening that receives the float tube therethrough.

7. The device of claim 1, wherein the vacuum generator is selected from at least one of a compressed air powered vacuum generator or an electric blower, or wherein the vacuum generator includes a venturi tube.

8. The device of claim 1 further comprising a container having an open end, wherein the lid is coupled to and covers the opens end.

9. The device of claim 1 wherein the filter is mounted on the lid and extends through the vacuum opening.

10. The device of claim 1 wherein the outer perimeter of the vacuum generator is entirely spaced away from the outer perimeter of the hatch.

11. The device of claim 1 wherein at least part of the vacuum generator is configured to be positioned on, externally of and vertically above the hatch when the hatch is in the closed position.

12. The device of claim 1 wherein the vacuum generator includes a float tube extending through the vacuum opening into an interior of the filter.

13. The device of claim 1 wherein the hatch is pivotally coupled to the lid, and wherein the hatch is flat and planar.

14. The device of claim 1 wherein the lid system is configured such that when the hatch is in the closed position and the filter is mounted on the lid, the hatch sealingly engages the flange about an entire perimeter thereof to form an airtight seal between the flange and the upper surface of the lid, such that the vacuum generator communicates with an interior of the container.

15. A device including a lid system for a wet-dry vacuum, the lid system comprising:

a lid shaped to cover an open end of a container, the lid having a vacuum opening therethrough;

a hatch coupled to the lid and configured to cover the vacuum opening when the hatch is in a closed position, wherein the hatch has an outer perimeter and a hatch opening at least partially spaced away from the outer perimeter, wherein the hatch extends continuously from the outer perimeter thereof to the hatch opening;

a vacuum generator mounted on the hatch and having a portion received in and extending through the hatch opening; and a filter having a flange, the filter being configured to be mounted on the lid and extend through the vacuum opening such that the flange engages an upper surface of the lid adjacent the vacuum opening to support the filter on the lid;

wherein at least a portion of the vacuum generator extends through the vacuum opening into an interior of the filter wherein the lid system is configured such that when the hatch is in the closed position and the filter is mounted on the lid, the hatch sealingly engages the flange to form an airtight seal between the hatch and the flange, wherein at least part of the vacuum generator is positioned externally of the closed volume; and wherein the lid system is configured such that when the hatch is in the open position, the filter is insertable into and removable from the vacuum opening.

16. The device of claim 15 wherein the hatch is pivotally coupled to the lid.

17. The device of claim 15 wherein the lid system is configured such that when the hatch is in the closed position and the filter is mounted on the lid, the hatch sealingly engages the flange about an entire perimeter thereof.

* * * * *